United States Patent [19]

Rassieur

[11] Patent Number: 4,638,871

[45] Date of Patent: Jan. 27, 1987

[54] EARTH DRILL RIG

[75] Inventor: Charles L. Rassieur, St. Louis, Mo.

[73] Assignee: Central Mine Equipment Company, St. Louis, Mo.

[21] Appl. No.: 704,074

[22] Filed: Feb. 21, 1985

[51] Int. Cl.[4] ..... E21B 15/04

[52] U.S. Cl. ..... 173/26; 173/41; 173/42

[58] Field of Search ..... 173/40, 41, 25, 26, 173/27, 28, 22, 42; 464/49, 162

[56] References Cited

U.S. PATENT DOCUMENTS

| | | | |
|---|---|---|---|
| 2,461,373 | 2/1949 | Cox | 173/26 |
| 3,012,619 | 12/1961 | Farque | 173/28 |
| 3,139,944 | 7/1964 | Smith | 173/26 |
| 3,252,527 | 5/1966 | Alexander et al. | 173/41 |
| 3,500,938 | 3/1970 | Watson | 173/40 |
| 3,942,336 | 3/1976 | Schultenkämper | 464/162 |

*Primary Examiner*—Frank T. Yost
*Assistant Examiner*—Hien H. Phan
*Attorney, Agent, or Firm*—Polster, Polster & Lucchesi

[57] ABSTRACT

In an earth drill rig wherein an upwardly and downwardly moving drill-string-turning rotary table is rotated by a kelly bar connected at its lower end to a vertical drive shaft, the kelly bar being journaled for rotation in and the rotary table being mounted for axial movement on a drill frame assembly, the drill frame assembly being mounted on a vehicle for pivoting between an upright position and a substantially horizontal position for transportation, a frame assembly pivot is positioned below the lower end of the kelly bar and a universal coupling connects the lower end of the kelly bar and the vertical drive shaft.

3 Claims, 6 Drawing Figures

EARTH DRILL RIG

BACKGROUND OF THE INVENTION

Standard earth drill rigs of the type manufactured and sold by Central Mine Equipment Company, among others, have been provided with an upright drill frame that pivots from a horizontal traveling position to a vertical drilling position. In those standard machines made heretofore, a drive train is connected between a right angle drive and a kelly bar by a flexible chain coupling, as illustrated in Fehrmann and Rassieur, U.S. Pat. No. 3,309,898. In these machines, somewhat diagramatically illustrated in FIGS. 5 and 6 of the accompanying drawing, when the drill is in a vertical position, the bottom of the kelly bar is just above the right angle drive vertical output shaft and below the pivot access of the drill frame. As indicated in FIG. 5, as the upright assembly is rotated from a horizontal to a vertical position or vice versa, the lower end of the kelly bar swings out away from the drill. This standard design does not allow for a connection between the output shaft and the kelly bar that will function at positions intermediate the horizontal and the vertical. In fact, in order to permit the drill frame to be swung to the horizontal position, the flexible chain coupling has to be raised on the kelly bar until it clears the vertical drive shaft.

One of the objects of this invention is to provide a drill rig in which the drill frame can be swung from vertical to horizontal without having to uncouple the vertical drive shaft from the kelly bar.

Another object is to provide such a drill rig in which the kelly bar, hence the rotary table, can be driven through any angle of the drill frame from substantially horizontal to vertical, to permit angled drilling.

Other objects will become apparent to those skilled in the art in the light of the following description and accompanying drawings.

SUMMARY OF THE INVENTION

In accordance with this invention, generally stated, in an earth drill rig wherein an upwardly and downwardly moving drill-string-turning rotary table is rotated by a kelly bar connected at its lower end to a vertical drive shaft, the kelly bar being journaled for rotation in and fixed against axial movement with respect to a drill frame assembly and the rotary table being mounted for axial movement on and along the drill frame assembly, the drill frame assembly being mounted on a vehicle for pivoting between an upright position and a substantially horizontal position for tranportation, a frame assembly pivot is positioned below the lower end of the kelly bar and a universal coupling connects the lower end of the kelly bar and the vertical drive shaft. In the preferred embodiment, the universal coupling includes pairs of yoke type universal joints at opposite ends of and connected by a splined connector for relative axial movement but driving coupling between the yoke type joints at the opposite ends of the splined connection, each of the yoke type universal joints includes a pivot fixed with respect to the vertical drive shaft at one end of the splined connection and a pivot fixed with respect to the kelly bar at the other end of the splined connection, the centers of the pivots lying on a circle of which the frame assembly pivot axis is the center.

DESCRIPTION OF THE PREFERRED EMBODIMENT

Figure 5:
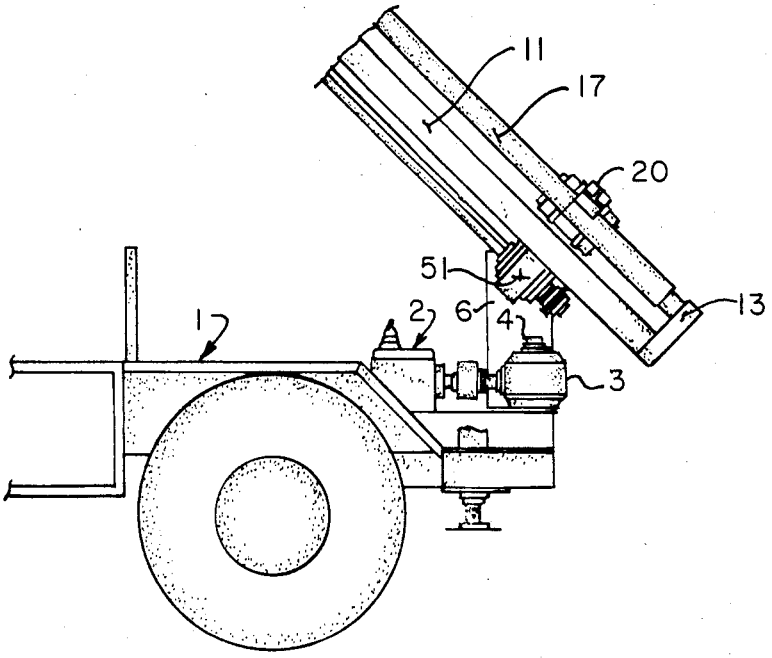
FIG. 5 is a fragmentary view in side elevation of a prior art drill rig with its frame assembly in a position intermediate the horizontal and vertical.
Figure 6:
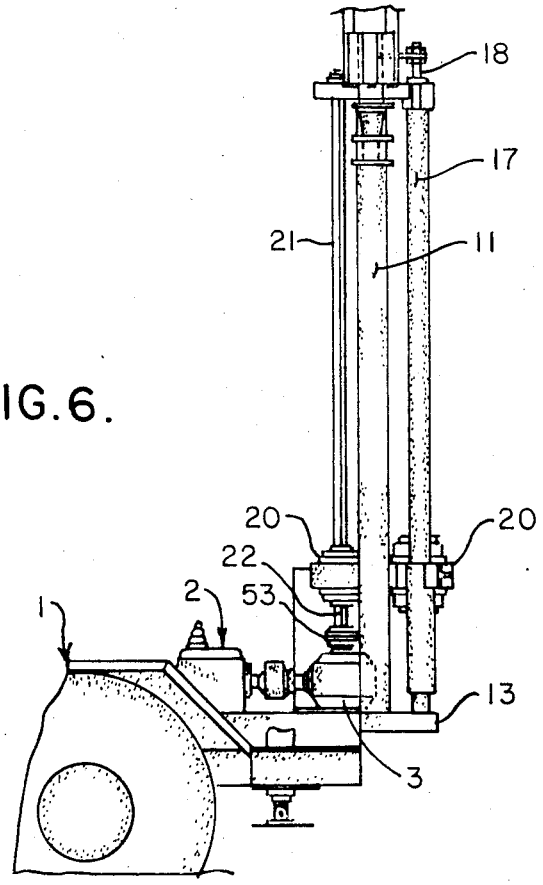
FIG. 6 a view of the drill rig shown in FIG. 5 with the drill rig frame assembly in vertical position, and the kelly bar coupled to a vertical drive shaft with a coupling of the type illustrated and described in Fehrmann et al, U.S. Pat. No. 3,309,898.

Referring now to the drawing, elements of the drilling rig of this invention that are common to the prior art of drilling rigs shown in FIGS. 5 and 6 include a vehicle 1 with a frame carrying a drill engine connected to a transmission 2 connected to an input shaft of a right angle drive 3, also carried by the vehicle 1. A vertical drive shaft 4 projects upwardly from the right angle drive 3. A vertical support 6, which may consist of a pair of spaced heavy plates, is secured to the frame of the vehicle 1.

A drill frame assembly 8 is pivotally mounted to the vertical support 6 by means of suitably massive pivot pins, not here shown. The drill frame assembly includes stanchions 11 to which is welded or otherwise secured a lower base plate 13, which may extend transversly between the stanchions 11 as indicated in a front view of a prior art device shown in U.S. Pat. No. 3,561,545. A header plate 16, which can be of the type shown in the same patent, extends transversly between the stanchions 11. Hydraulic cylinders 17, from which piston rods 18 extend, are also conventional. A rotary table 20 is mounted to slide axially on the hydraulic cylinders 17 and on a kelly bar 21. The kelly bar 21 in the embodiments shown is square and is received in a square opening in a hub of a sprocket inside the rotary table housing.

The kelly bar 21 is journaled for rotation at its upper end in a bearing carried by the header plate 16. A lower end 22 of the kelly bar in the conventional rig as shown in FIGS. 5 and 6, projects beyond the rotary table 20 and is free. It is coupled to the vertical drive shaft 4 by means of a chain coupling 53, which must be pulled up out of the way on the kelly bar as shown in FIG. 5, and then dropped into place when the kelly bar and vertical drive shaft 4 are aligned, as shown in FIG. 6.

In the conventional rig, the drill frame assembly pivot axis, indicated by the reference numeral 51 in FIG. 5, is, as will be seen from that figure, above the end 22 of the kelly bar. This means that the end 22 of the kelly bar swings outwardly away from the drive shaft 4 when the drill frame assembly 8 is in any intermediate position between the vertical and the horizontal, as illustrated in FIG. 5. This not only means that the chain coupling 53 must be raised manually when the drill frame assembly is moved from the vertical, but that the vertical drive shaft 4 is disconnected from the kelly bar so that drilling can be done only in the vertical position, when the kelly bar and the vertical drive shaft are exactly aligned.

Figure 1:
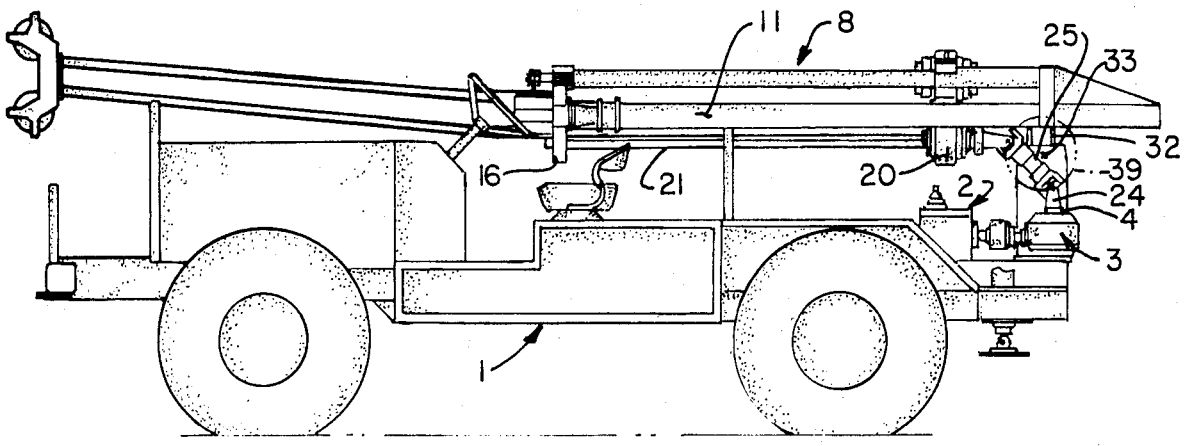
FIG. 1 is a view in side elevation of one embodiment of drill rig of this invention, mounted on a vehicle, with a drill frame assembly in substantially horizontal position.
Figure 2:
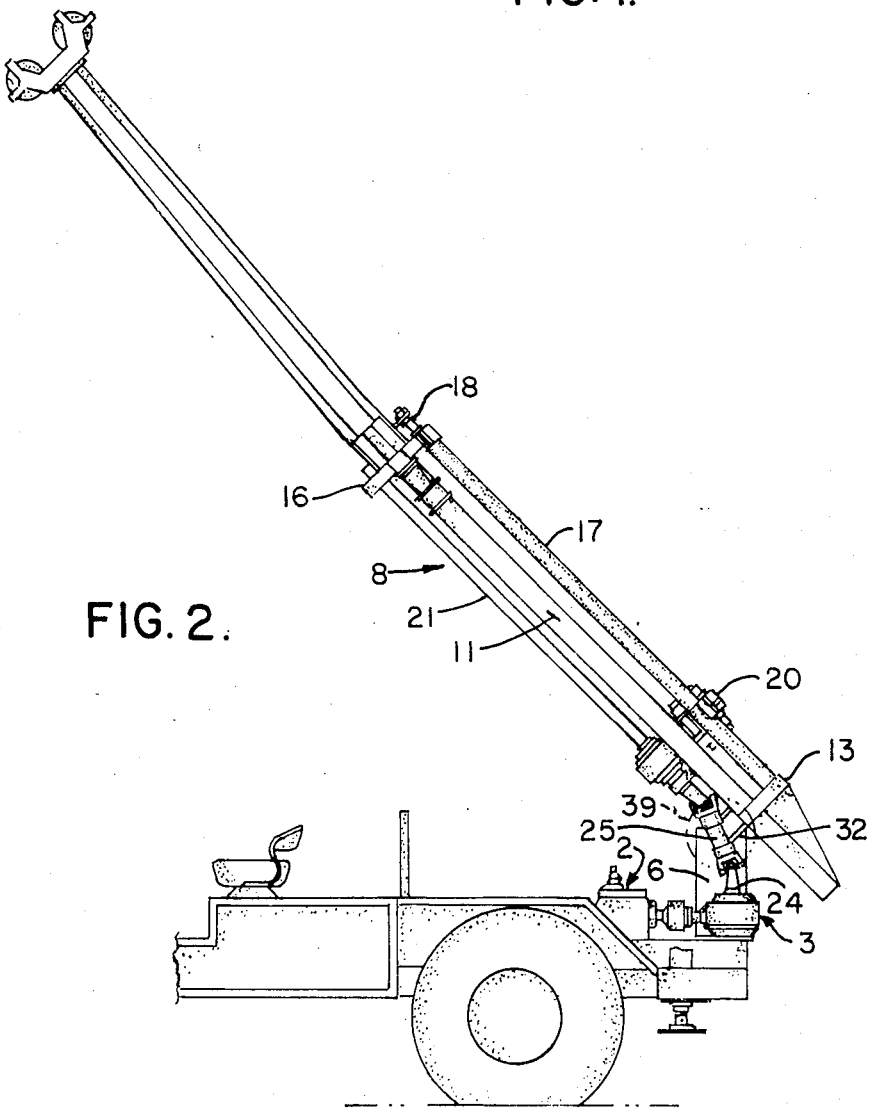
FIG. 2 is a view in side elevation with the drill rig frame assembly in intermediate position.
Figure 3:
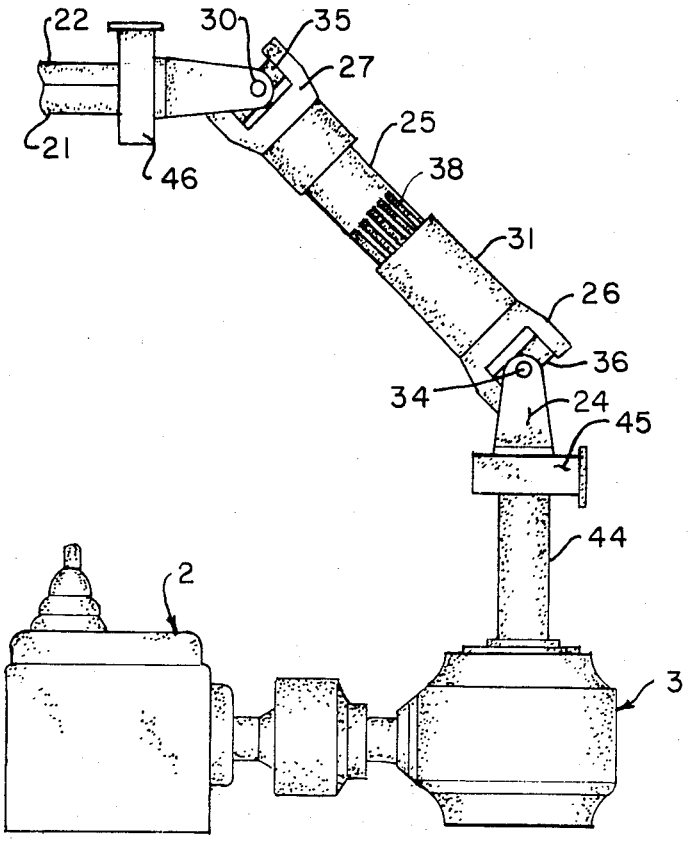
FIG. 3 is a view in side elevation of the drill rig frame assembly in vertical position.
Figure 4:
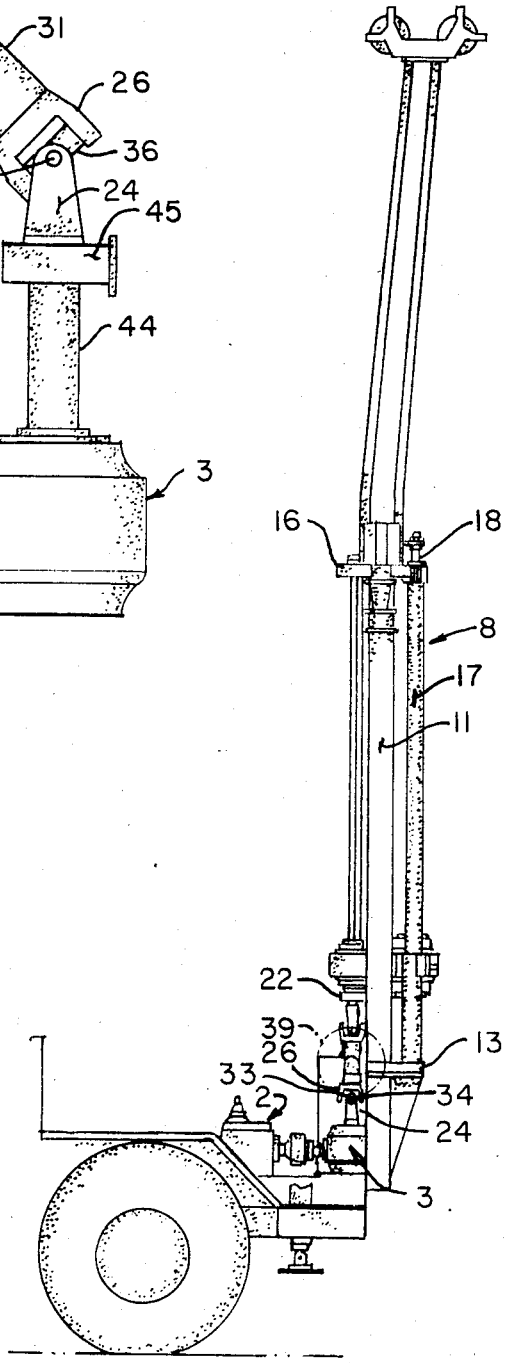
FIG. 4 is a somewhat enlarged, fragmentary detailed view of a modified form of universal coupling.

Referring now to FIGS. 1 through 3 for one illustrative embodiment of drill rig of this invention, and to FIG. 4 for some details common to both embodiments and which are shown enlarged in FIG. 4, the drive shaft 4 shown in FIG. 5 in the conventional rig has in the rig of this invention a drive shaft yoke 24 attached to it, with two arms carrying between them a drive shaft yoke pin 34, pivotally connected to a pin 36 of an outer connector yoke 26. The yoke 26 has a pair of arms carrying the pin 36, and a sleeve 31, shown as integral with the arms. The sleeve 31 is internally splined and is mounted for axial but not rotary movement with respect to a splined connector 25, external splines 38 of which are complementary to the internal splines of the sleeve 31. At its upper end, the connector 25 carries an inner connector yoke 27, a pin 35 of which is pivotally connected to a pin 30 of a kelly bar yoke 28 mounted to the lower end 22 of the kelly bar 21.

The drill frame assembly carries a pivot plate 32 by which the drill frame assembly is pivoted to the vertical support 6 about a drill frame assembly pivot axis 33 that is shown particularly in FIG. 1. It will be observed that the pivot axis 33 is below the lower end 22 of the kelly bar and below the pin 30 of the inner connector yoke 27 as well. The point of intersection of the axes of the kelly bar yoke pin 30 and the inner connector yoke pin 35, and the point of intersection of the axes of the drive shaft yoke pin 34 and the outer splined connector yoke pin 36 lie on a circle 39 of which the drill frame assembly pivot axis 33 is the center. The pivot axis 33 is slightly to the left of the long axis of the connector 25 when the drill frame assembly is vertical as shown in FIG. 3, and to the right of the long axis of the connector 25 when the drill frame assembly is in substantially horizontal position as shown in FIG. 1. In one intermediate position, the axis of the connector 25 is diametric with respect to the circle 39. As shown particularly in FIG. 4, the sleeve 31 of the outer splined connector yoke can be long as compared with the sleeve of the inner connector yoke 27 so as to permit axial movement only of the connector and sleeve 31 relative to one another to provide effective shortening of the connector in the chordal positions of the connector and lengthening as it reaches the diametric position. If it is desired, both sleeves can be splined, the connector can be splined throughout its length and both can be permitted to move axially.

By putting the pivot axis of the drill frame assembly below the outer end of the kelly bar, between the lower end of the kelly bar and the vertical drive shaft, and connecting the vertical drive shaft to the kelly bar with a universal connector, the connection between the vertical drive shaft and the kelly bar can be maintained at any angle, so that the kelly bar need not be disconnected as it had to be with the prior art machines. Furthermore, the drill itself can be operated at any angle between the horizontal and the vertical, which increases the versatility and usefulness of the drill rig. The geometry of the preferred embodiment, in which the pivot axes of the drive shaft and kelly bar universal joints lie always on a circle of which the drill frame assembly pivot axis is the center has the virtue of making the angles of the U-joints equal and permitting the drive line to be rotated with a minimum of vibration.

Referring to FIG. 4, an embodiment of drive is shown in which an extension shaft 44 is provided to the right angle drive, stabilized by a bearing 45 that can be mounted on the vertical support 6. A bearing 46, mounted to the drill frame assembly, is also shown as stabilizing the lower end of the kelly bar. This construction is used on drills that require a high pivot point so that the drill frame will clear a high drill engine. In every other respect, the construction is the same as that shown in FIGS. 1 through 3.

Numerous variations in the construction of the device of the invention within the scope of the depending claims will occur to those skilled in the art in the light of the foregoing disclosure. Merely by way of example, the connector can be an internally splined sleeve and its yokes provided with externally splined shafts slidably mounted in the sleeve. This is merely illustrative.

I claim:

1. In an earth drill rig wherein an upwardly and downwardly moving drill-string-turning rotary table is rotated by a kelly bar connected at its lower end to a vertical drive shaft, said kelly bar being journalled for rotation in and fixed against axial movement with respect to a drill frame assembly and said rotary table being mounted for axial movement on and along said drill frame assembly, said drill frame assembly being pivotally mounted on a vehicle on a substantially horizontal axis for pivoting between an upright position and a substantially horizontal position for transportation, the improvement comprising said drill frame assembly pivot axis positioned below the lower end of the kelly bar and above the upper end of said vertical drive shaft, and a universal coupling connecting said lower end of said kelly bar and said vertical drive shaft said universal coupling comprising universal joints at opposite ends of an elongated slip joint connector and connected thereby for relative axial movement but driving coupling between said universal joints, said universal joints lying generally on a circle of which the drill frame assembly pivot axis is the center, whereby said drill frame assembly can be moved between said upright and said substantially horizontal positions without disconnecting said kelly bar from said vertical drive shaft, said kelly bar being revolvable by said drive shaft through substantially the entire range of movement of said drill frame assembly.

2. The improvement of claim 1 wherein said universal coupling comprises yoke type universal joints at opposite ends of and connected by an elongated, splined connector for relative axial movement but driving coupling between said yoke type joints at said opposite ends.

3. The improvement of claim 2 wherein the said yoke type universal joints include a pivot fixed with respect to said vertical drive shaft at one end of said connector and a pivot fixed with respect to said kelly bar at the other end of said connector, the centers of said pivots lying on a circle of which the drill frame assembly pivot axis is the center.

* * * * *